United States Patent [19]

Hayashi

[11] Patent Number: 4,658,765

[45] Date of Patent: Apr. 21, 1987

[54] COOLING SYSTEM FOR AUTOMOTIVE ENGINE OR THE LIKE

[75] Inventor: Yoshimasa Hayashi, Kamakura, Japan

[73] Assignee: Nissan Motor Co., Ltd., Yokohama, Japan

[21] Appl. No.: 852,158

[22] Filed: Apr. 15, 1986

[30] Foreign Application Priority Data

Jul. 5, 1985 [JP] Japan ..... 60-147813

[51] Int. Cl.[4] ..... F01P 3/22

[52] U.S. Cl. ..... 123/41.21; 123/41.24; 123/41.27

[58] Field of Search ..... 123/41.2, 41.27; 165/104.27, 104.32

[56] References Cited

U.S. PATENT DOCUMENTS

| | | | |
|---|---|---|---|
| 1,346,331 | 7/1920 | Muir | 123/41.21 |
| 1,558,009 | 10/1925 | Giesler | 123/41.21 |
| 1,643,510 | 9/1927 | Muir | 123/41.08 |
| 1,676,961 | 7/1928 | Muir | 123/41.08 |
| 1,891,480 | 12/1932 | Ross | 123/41.08 |
| 4,367,699 | 1/1983 | Evans | 123/41.23 |
| 4,572,115 | 2/1986 | Hayashi | 123/41.21 |

*Primary Examiner*—William A. Cuchlinski, Jr.

*Attorney, Agent, or Firm*—Schwartz, Jeffery, Schwaab, Mack, Blumenthal & Evans

[57] ABSTRACT

In order to simplify the control and construction of the cooling system in a manner which avoids the need for costly electromagnetic valves and control circuits such as microprocessor and the like, a reservoir in which coolant is stored is arranged to constantly communicate with a lower portion of a cooling circuit which includes the coolant jacket and the radiator in which the coolant vapor is condensed. A small coolant pump returns condensate from the radiator to the coolant jacket in response to a temperature sensor disposed in the coolant jacket. An overflow conduit is arranged to return excess coolant pumped into the coolant jacket via a conduit which leads from an overflow port provided in the cylinder head at a predetermined height above highly heated structure of the engine to the base of the radiator and thus maintain a predetermined depth of liquid coolant in the jacket. A cooling fan or like device is operated in response to a second temperature sensor disposed at the bottom of the radiator.

7 Claims, 6 Drawing Figures

COOLING SYSTEM FOR AUTOMOTIVE ENGINE OR THE LIKE

BACKGROUND OF THE INVENTION

1. Field of the Invention

The present invention relates generally to an evaporative type cooling system for an internal combustion engine wherein liquid coolant is permitted to boil and the vapor used as a vehicle for removing heat therefrom, and more specifically to such a system which does not require complex electromagnetic valves and control circuits for its operation and which can constantly maintain the cooling circuit of the system free of contaminating air and the like non-condensble matter.

2. Description of the Prior Art

In currently used "water cooled" internal combustion engines (liquid) is forcefully circulated by a water pump, through a cooling circuit including the engine coolant jacket and an air cooled radiator. This type of system encounters the drawback that a large volume of water is required to be circulated between the radiator and the coolant jacket in order to remove the required amount of heat.

Further, due to the large mass of water inherently required, the warm-up characteristics of the engine are undesirably sluggish. For example, if the temperature difference between the inlet and discharge ports of the coolant jacket is 4 degrees, the amount of heat which 1 Kg of water may effectively remove from the engine under such conditions is 4 Kcal. Accordingly, in the case of an engine having an 1800 cc displacement (by way of example) is operated full throttle, the cooling system is required to remove approximately 4000 Kcal/h. In order to achieve this, a flow rate of 167 liter/min (viz., $4000-60\times14$) must be produced by the water pump. This of course undesirably consumes several horsepower.

FIG. 2 shows an arrangement disclosed in Japanese Patent Application Second Provisional Publication Sho. 57-57608. This arrangement has attempted to vaporize a liquid coolant and use the gaseous form thereof as a vehicle for removing heat from the engine. In this sytem the radiator 1 and the coolant jacket 2 are in constant and free communication via conduits 3, 4 whereby the coolant which condenses in the radiator 1 is returned to the coolant jacket 2 little by little under the influence of gravity. This arrangement while eliminating the power consuming coolant circulation pump which plagues the above mentioned arragement, has suffered from the drawbacks that the radiator, depending on its position with respect to the engine proper, tends to be at least partially filled with liquid coolant. This greatly reduces the surface area via which the gaseous coolant (for example steam) can effectively release its latent heat of vaporization and accordingly condense, and thus has lacked any notable improvement in cooling efficiency. Further, with this sytem in order to maintain the pressure within the coolant jacket and radiator at atmospheric level, a gas permeable water shedding filter 5 is arranged as shown, to permit the entry of air into and out of the system.

However, this filter permits gaseous coolant to readily escape from the system, inducing the need for frequent topping up of the coolant level. A further problem with this arrangement has come in that some of the air, which is sucked into the cooling system as the engine cools, tends to dissolve in the water, whereby upon start up of the engine, the dissolved air tends to come out of solution and forms small bubbles in the radiator which adhere to the walls thereof and form an insulating layer. The undissolved air also tends to collect in the upper section of the radiator and inhibit the convection-like circulation of the vapor from the cylinder block to the radiator. This of course further deteriorates the performance of the device.

European Patent Application Provisional Publication No. 0 059 423 published on Sept. 8, 1982 discloses another arrangement wherein, liquid coolant in the coolant jacket of the engine, is not forcefully circulated therein and permitted to absorb heat to the point of boiling. The gaseous coolant thus generated is adiabatically compressed in a compressor so as to raise the temperature and pressure thereof and thereafter introduced into a heat exchanger (radiator). After condensing, the coolant is temporarily stored in a reservoir and recycled back into the coolant jacket via a flow control valve. This arrangement has suffered from the drawback that when the engine is stopped and cools down the coolant vapor condenses and induces sub-atmospheric conditions which tend to induce air to leak into the system. This air tends to be forced by the compressor along with the gaseous coolant into the radiator.

Due to the difference in specific garvity, the above mentioned air tends to rise in the hot environment while the coolant which has condensed moves downwardly. The air, due to this inherent tendency to rise, tends to form pockets of air which cause a kind of "embolish" in the radiator and which badly impair the heat exchange ability thereof. With this arrangement the provision of the compressor renders the control of the pressure prevailing in the cooling circuit difficult.

U.S. Pat. No. 4,367,699 issued on Jan. 11, 1983 in the name of Evans (see FIG. 3 of the drawings) discloses an engine system wherein the coolant is boiled and the vapor used to remove heat from the engine. This arrangement features a separation tank 6 wherein gaseous and liquid coolant are initially separated. The liquid coolant is fed back to the cylinder block 7 under the influence of gravity while the relatively dry gaseous coolant (steam for example) is condensed in a fan cooled radiator 8.

The temperature of the radiator is controlled by selective energizations of the fan 9 which maintains a rate of condensation therein sufficient to provide a liquid seal at the bottom of the device. Condensate discharged from the radiator via the above mentioned liquid seal is collected in a small reservoir-like arrangement 10 and pumped back up to the separation tank via a small constantly energized pump 11.

This arrangement, while providing an arrangement via which air can be initially purged to some degree from the system tends to, due to the nature of the arrangement which permits said initial non-condensible matter to be forced out of the system, suffers from rapid loss of coolant when operated at relatively high altitudes. Further, once the engine cools air is relatively freely admitted back into the system. The provision of the bulky separation tank 6 also renders engine layout difficult.

Japanese Patent Application First Provisional Publication No. Sho. 56-32026 (see FIG. 4 of the drawings) discloses an arrangement wherein the structure defining the cylinder head and cylinder liners are covered in a porous layer of ceramic material 12 and wherein coolant is sprayed into the cylinder block from shower-like arrangements 13 located above the cylinder heads 14. The interior of the coolant jacket defined within the engine proper is essentially filled with gaseous coolant during engine operation at which time liquid coolant sprayed onto the ceramic layers 12.

However, this arrangement has proven totally unsatisfactory in that upon boiling of the liquid coolant absorbed into the ceramic layers, the vapor thus produced and which escapes toward and into the coolant jacket, inhibits the penetration of fresh liquid coolant into the layers and induces the situation wherein rapid overheat and thermal damage of the ceramic layers 12 and/or engine soon results. Further, this arrangement is of the closed circuit type and is plagued with air contamination and blockages in the radiator similar to the compressor equipped arrangement discussed above.

FIG. 5 shows an arrangement which is disclosed in U.S. Pat. No. 4,549,505 issued on Oct. 29, 1985 in the name of Hirano. The disclosure of this application is hereby incorporated by reference thereto. For convenience the same numerals as used in the above mentioned Patent are also used in FIG. 7.

However, this arrangement while solving the drawbacks encountered with the previously disclosed prior art has itself suffered from the drawbacks that it requires no less than four electromagnetic valves and a highly complex control circuit (in this case a microprocessor) to control the same. This, while permitting the variation of the temperature at which the coolant boils with respect to the instant engine speed and load, notably increases the complextity and cost of the system considerably. Further, in the event that one of the valves or the control circuit malfunctions the operablity of the whole system is placed in jeopardy and is likely to result in engine damage or temporary inoperablity.

SUMMARY OF THE INVENTION

It is an object of the present invention to provide an evaporative cooling system wherein the cooling circuit of the system can be continually maintained essentially free of non-condensible matter without the need of a complex control system.

In brief, the above object is achieved by an arrangement wherein a reservoir in which coolant is stored, is arranged to constantly communicate with a lower portion of a cooling circuit which includes the coolant jacket and the radiator in which the coolant vapor is condensed. A small coolant pump returns condensate from the radiator to the coolant jacket in response to a temperature sensor disposed in the coolant jacket. An overflow conduit is arranged to return excess coolant pumped into the coolant jacket via an overflow conduit which leads from an overflow port (or ports) provided in the cylinder head at a predetermined height above highly heated structure of the engine, to the base of the radiator and thus maintain a predetermined depth of liquid coolant in the jacket. A cooling fan or like device is operated in response to a second temperature sensor disposed at the bottom of the radiator.

More specifically, a first aspect of the present invention comes in the form of a cooling system for an automotive engine or the like which has a structure subject to a high heat flux, the system being characterized by: a coolant jacket disposed about said structure and into which coolant is introduced in liquid form and discharged in gaseous form; a radiator in fluid communication with said coolant jacket and in which coolant vapor is condensed to form a condensate, said radiator including a small collection vessel disposed at the bottom thereof in which the condensate formed in the radiator is collected; a first temperature sensor disposed in the coolant jacket; a pump which pumps the condensate from the radiator to the coolant jacket through a coolant return conduit, the pump being responsive to the first temperature sensor in a manner that the pump is energized when the temperature of the coolant in the coolant jacket is above a first predetermined level; a second temperature sensor disposed in the radiator; a device associated with the radiator for varying the rate of heat exchange between the radiator and a cooling medium surrounding the radiator, the device being responsive to the second temperature sensor in a manner to assume a condition in which the rate of heat exchange is increased upon the temperature in the radiator exceeding a second predetermined level; an overflow port formed in the coolant jacket at a predetermined height above the structure, the overflow port fluidly communicating with the collection vessel of the radiator so that excess coolant pumped into the coolant jacket by the pump overflows through the overflow port to the lower tank; and a reservoir in which coolant is stored which fluidly communicates with the collection vessel of the radiator.

A second aspect of the present invention comes in the form method of cooling an internal combustion engine which has a structure subject to high heat flux, comprising: introducing liquid coolant into a coolant jacket disposed about the structure; permitting the coolant to boil and produce coolant vapor; condensing the vapor produced in the coolant jacket in a radiator; sensing the temperature of the coolant in the coolant jacket; pumping coolant from the radiator to the coolant jacket in response to the temperature of the coolant in the coolant jacket being sensed as being above a first predetermined level; permitting coolant in the coolant jacket above a predetermined height above the structure to overflow via an overflow port to the radiator; sensing the temperature of the liquid coolant in the radiator; varying the rate of heat exchange between the radiator and a cooling medium surrounding the same in a manner to increas the amount of heat removed from the radiator in response to the temperature of the liquid coolant in the radiator being above a second predetermined level.

BRIEF DESCRIPTION OF THE DRAWINGS

The features and advantages of the arrangement of the present invention will become more clearly appreciated from the following description taken in conjunction with the accompanying drawings in which.

DETAILED DESCRIPTION OF THE PREFERRED EMBODIMENT

Figure 6:
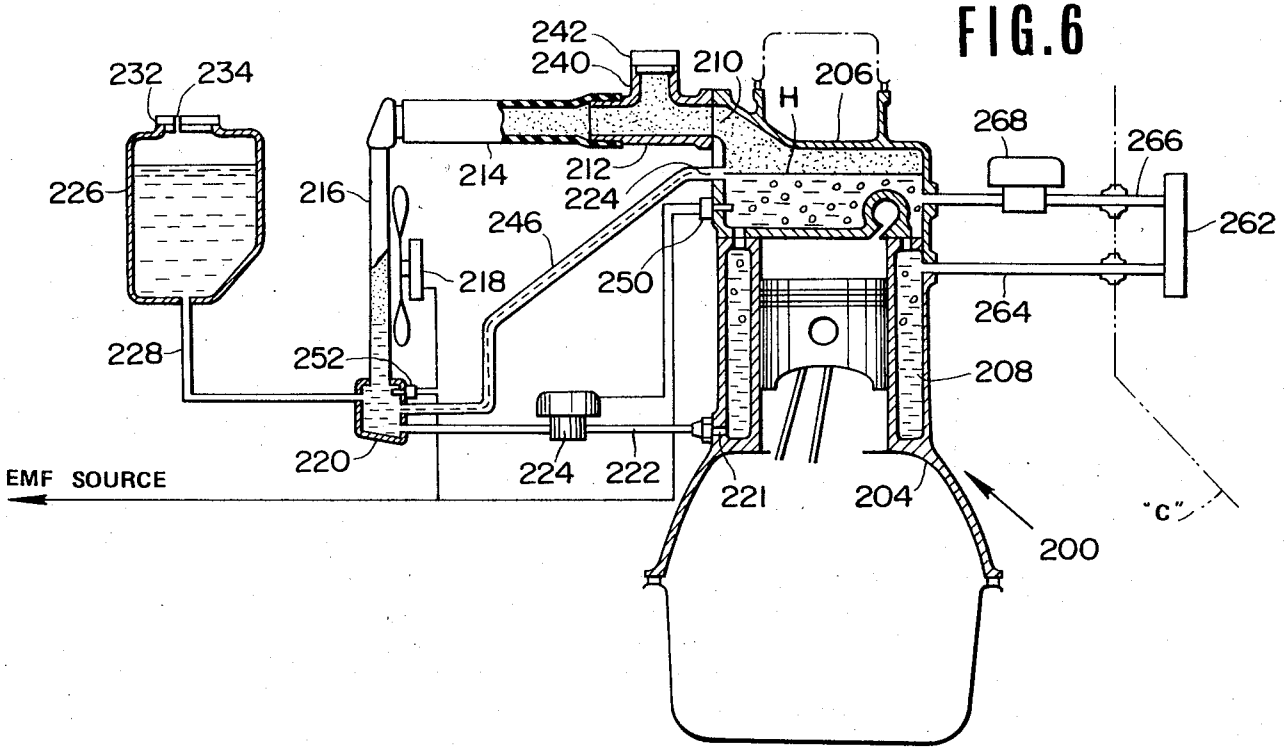
FIG. 6 shows an embodiment of the present invention.

FIG. 6 of the drawings shows an engine system to which a first embodiment of the invention is applied. In this arrangement an internal combustion engine 200 includes a cylinder block 204 on which a cylinder head 206 is detachably secured. The cylinder head and block are formed with suitably cavities which define a coolant jacket 208 about the heated structure of the engine (e.g. structure defining the combustion chambers exhaust valves conduits etc.,).

Fluidly communicating with a vapor discharge port 210 formed in the cylinder head 206 via a vapor manifold 212 and vapor conduit 214, is a condensor 216 or radiator as it will be referred to hereinafter. Located adjacent the radiator 216 is a selectively energizable electrically driven fan 218 which is arranged to induce a cooling draft of air to pass over the heat exchanging surface of the radiator 216 upon being energized.

A small collection reservoir 220 or lower tank as it will be referred to hereinlater, is provided at the bottom of the radiator 216 and arranged to collect the condensate produced therein. Leading from the lower tank 220 to a coolant inlet port 221 formed in the cylinder head 206 is a coolant return conduit 222. A small capacity electrically driven pump 224 is disposed in this conduit. The capacity of this pump 224 is selected to be such that it pumps coolant a rate slightly greater than the maximum requirement of the engine 200. This rate can be approximated using parameters such as the maximum amount of fuel combusted in the engine per unit time and confirmed by empirical results. It is important that the rate at which the pump 224 pumps be higher than the maximum requirement so that during engine operation the maintainance of the desired level (H) of coolant in the coolant jacket 208 will assured as will become apparent hereinlater.

A coolant reservoir 226 is arranged to constantly communicate with the the lower tank 220 via a supply/-discharge conduit 228. The reservoir 226 is closed by a cap 232 in which an air bleed 234 is formed. This permits the interior of the reservoir 226 to be maintained constantly at atmospheric pressure.

The vapor manifold 212 in this embodiment is formed with a riser portion 240. This riser portion 240 as shown, is provided with a cap 242 which hermetically closes the same.

Leading from one or more overflow ports 244 formed in the cylinder head 206 to the lower tank 220 is an overflow conduit 246. With the present invention the overflow port or ports 244 are arranged at a predetermined height H above the sutructure of the engine 200 which is subject to maximum heat flux. Viz., the structure which defines the cylinder head, exhaust ports, valves etc. This height (H) is selected to ensure that the engine structure which is subject to high heat flux remains immersed in a depth of liquid coolant which ensures constant wetting even under heavy load operation when the boiling of the coolant becomes sufficiently vigourous to tend to induce localized dry-outs and cavitation. These phenomena are apt to cause localized overheating which can lead to serious engine damage.

In order to control the operation of the coolant return pump 224 a first temperature sensor 250 is disposed in the cylinder head at a level lower than H and in a manner to be immersed in the liquid coolant contained in the coolant jacket 208 proximate the highly heated engine structure. This sensor 250 is arranged to switch to a state wherein electrical current is supplied to the coolant return pump 224 upon a predetermined temperature being reached. In this embodiment the temperature is set at 85° C. This value is selected to correspond to the lowest temperature at which the coolant is apt to boil. For example, the temperature at which the coolant boils at elevated alititudes such as atop of a mountain.

In order to control the operation of the cooling fan 218 a second temperature sensor 252 is disposed in the lower tank 220. This sensor 252 is set to respond to the temperature of the coolant in the lower tank 220 reaching the same value as the first one, viz., 85° C.

A cabin heating circuit is arranged to communicate with the coolant jacket. This circuit as shown includes a heat core 262 arranged in a passenger compartment "C", an induction conduit 264 which leads from a section of the coolant jacket formed in the cylinder block 204 to the core 262, and a return conduit 266 which leads from the core to a section of the coolant jacket formed in the cylinder head 206. A coolant circulation pump 268 is disposed in the return conduit 266. This pump 268 is selectively energizable by the closure of a switch or the like not shown.

Figure 1:
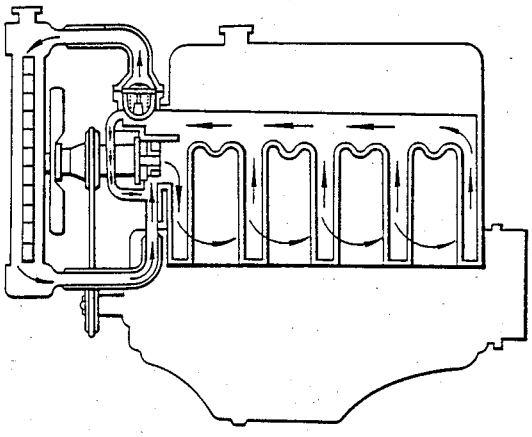
FIG.1 (PRIOR ART)
FIGS. 1 to 4 show the prior art arrangements discussed in the opening paragraphs of the instant disclosure.
Figure 2:
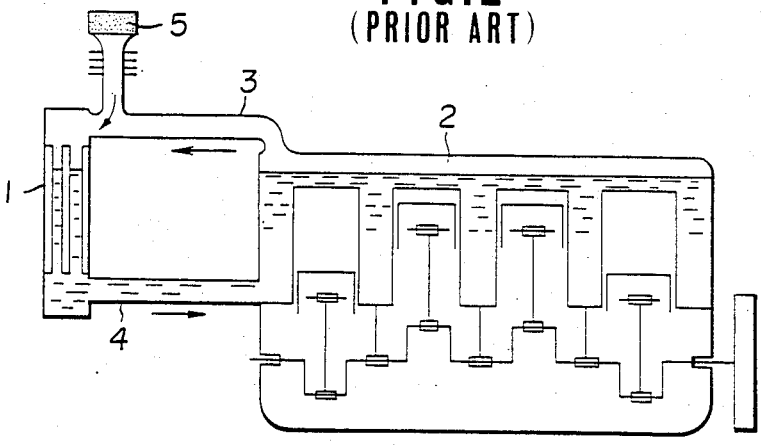
FIG.2 (PRIOR ART)
Figure 3:
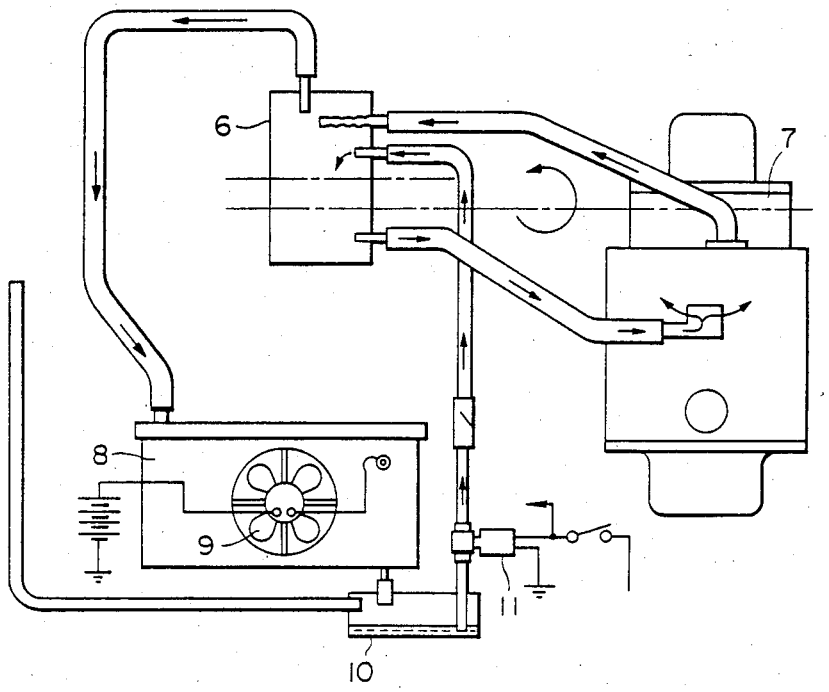
FIG. 3 (PRIOR ART)
Figure 4:
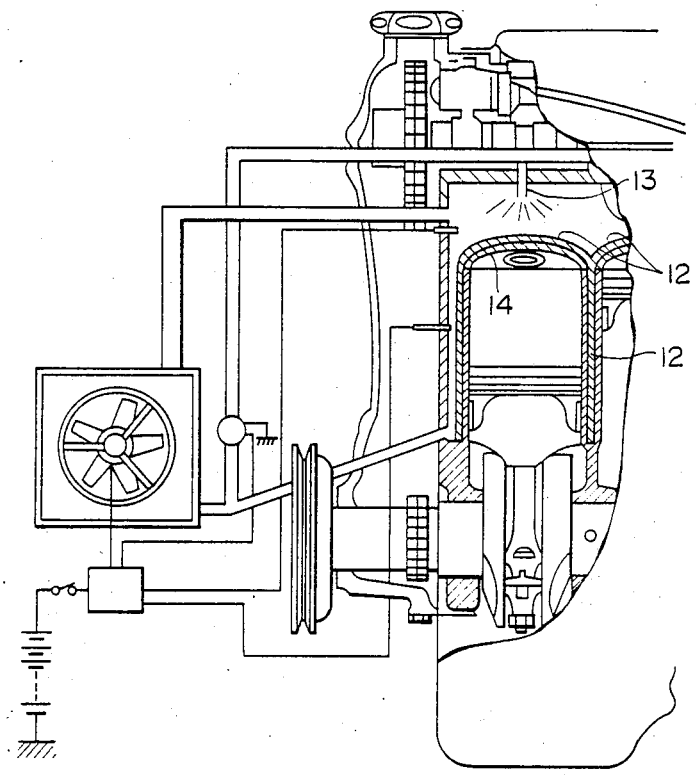
FIG.4 (PRIOR ART)
Figure 5:
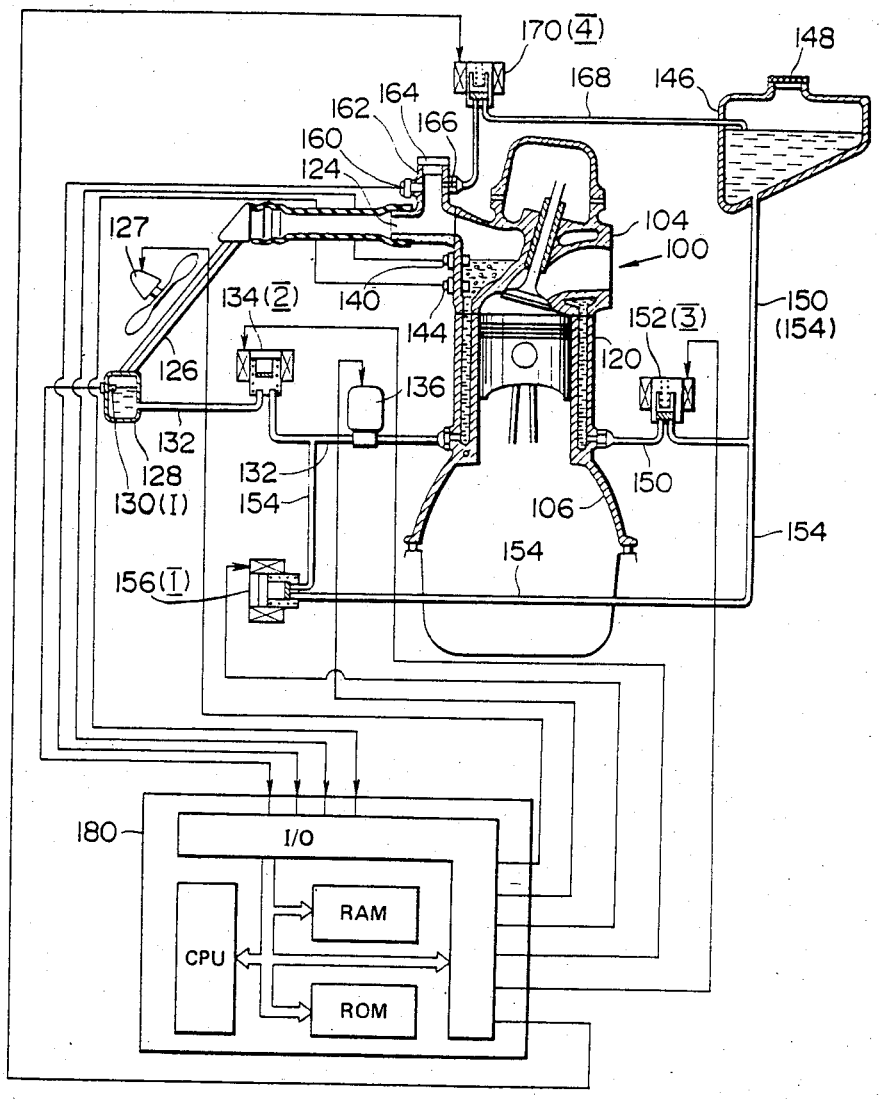
FIG. 5 shows in schematic elevation the arrangement disclosed in the opening paragraphs of the instant disclosure in conjunction with U.S. Pat. No. 4,549,505.

In operation the above disclosed arrangement is such that when the engine 200 is subject to a cold start, viz., when the engine coolant is below 85° C. by way of example, as the coolant in the coolant jacket 208 is not circulated at all, the coolant therein quickly warms. Upon reaching the predermined temperature the coolant return pump 224 is energized by temperature sensor 250 and coolant is pumped from the lower tank 220 to the coolant jacket 208 via conduit 222. However, as the volume of coolant circulated is not large by comparison with the arrangement shown in FIG. 1 of the drawings the rate at which the coolant heats to its boiling point is high. The coolant vapor generated at this time produces pressure which displaces liquid coolant out of the cooling circuit (viz., a closed loop circuit comprises of the coolant jacket 208, vapor manifold 212, vapor transfer conduit 214, radiator 216, and coolant return conduit 222.) to the reservoir 226 via conduit 228.

If the natural draft of air over the heat exchanging surfaces of the radiator 216 is such as to be insufficient to maintain the temperature of the coolant in the lower tank 220 (a mixture of the condensate which is formed via the condensation of the coolant vapor in the radiator 216 and the coolant which overflows from the coolant jacket 208 via overflow conduit 246) below the predetermined level, fan 218 is energized to increase the rate of heat exchange between the radiator 216 and the surrounding ambient air and thus strive to reduce the temperature in the lower tank 220.

It will be noted that this energization is such as to maintain the interior of the system as essentially atmospheric and permit the level of liquid coolant in the radiator 216 to adjust itself in a manner which controls the surface area of the radiator 216 available for the coolant vapor to release its latent heat of vaporization. In cold climates the radiator 216 will tend to be partially filled with liquid coolant while in hotter environments the level will automatically lower in a manner to allow for the reduced difference in temperature between the interior and the exterior of the radiator 216.

In the event that some non-condensible matter finds its way into the cooling circuit to the degree that sufficient heat cannot be released from the system, the temperature and pressure within the cooling circuit rises. Simultaneously, the non-condensible matter (e.g. air) which exhibits natural insulating properties and thus tends to be less heated (cooler) than the coolant vapor tends to be pushed down toward the bottom of the radiator 216 and eventually discharged out of the system via conduit 228 and reservoir 226. Any coolant vapor which is vented at this time tends to condense upon contact with the liquid coolant in the reservoir 226 and not lost permanently from the system.

This "hot purge" of non-condensible matter tends to maintain the system free of air and the like during running of the engine.

It will be noted that the maximum heat exchange capacity of the radiator 216 is selected to be greater than the maximum heat exchange requirement of system so that under normal circumstances the level of liquid coolant in the lower tank 220 does not fall below that at which conduit 228 communicates therewith.

When the engine 200 is stopped it is advantageous to maintain the supply of electrical power to the fan 218, pump 224 and sensors 250, 252. This provision allows for the boiling which occurs after the engine 200 is stopped due to the heat (thermal inertia) which has accumulated in the cylinder head 206, cylinder block 204 and associated structure and prevents pressure build up which might displace coolant out of the cooling circuit to the reservoir 226 with sufficient violence that spillage or similar loss may occur. That is to say, if the fan 218 and pump 224, are permitted to continuation operation to remove heat from the system and circulate cooled coolant collected in the lower tank 220 back into the coolant jacket 208 until the temperatures in the coolant jacket 208 and lower tank 220 drop to the above mentioned predetermined values, the chances that the coolant will be permitted to boil sufficiently to invite any violent displacement of coolant from the cooling circuit are essentially zero.

As the temperature of the system drops and the vapor in the upper section of the coolant jacket 208 and in the radiator 216 condenses to its liquid state. Accordingly, as the pressure in the cooling circuit lowers, coolant from the reservoir 226 is inducted via conduit 228 under the influence of the resultant pressure differential until such time as the pressure differential ceases to exist or the cooling circuit is completely filled with liquid coolant. Under these circumstances the tendancy for air or the like contaminating non-condensible matter to leak into the system during non-use is essentially non-existent.

Upon engine start-up the previously outlined warm-up process wherein the coolant vapor produced displaces the excess coolant introduced to prevent cooling circuit contamination, out to the reservoir 226 until such time as an equilibrium between the rate of condensation in the radiator 216 and the amount of heat produced by the engine is established.

In the instant embodiment the coolant used takes the form of water containing a suitably amount of anti-freeze and a trace of anti-corrosive. It will be noted that even through the coolant vapor which is transferred through the vapor conduit 214 to the radiator 216 contains very little anti-freeze, the latter tending to concentrate in the coolant jacket, the constant energization of the coolant return pump 224 above a predetermined coolant temperature causes a small amount of coolant liquid coolant to be circulated through the overflow and coolant return conduits 246, 222 under nearly all modes of engine operation (including the cool-down mode following stoppage of the engine) and thus adequately prevents any notable anti-freeze concentration difference from occuring. Hence, in very cold climates freezing of the coolant in the radiator 216 and like elements of system is essentially obviated.

What is claimed is:

1. In an internal combustion engine having a structure subject to high heat flux:

a cooling system comprising:

a coolant jacket disposed about said structure and into which coolant is introduced in liquid form and discharged in gaseous form;

a radiator in fluid communication with said coolant jacket and in which coolant vapor is condensed to form a condensate, said radiator including a small collection vessel disposed at the bottom of said radiator in which said condensate is collected;

a first temperature sensor disposed in said coolant jacket;

a pump which pumps the condensate from said radiator to said coolant jacket through a coolant return conduit, said pump being responsive to said first temperature sensor in a manner that said pump is energized when the temperature of the coolant in said coolant jacket is above a first predetermined level;

a second temperature sensor disposed in said radiator;

a device associated with said radiator for varying the rate of heat exchange between the radiator and a cooling medium surrounding said radiator, said device being responsive to said second temperature sensor in a manner to assume a condition in which the rate of heat exchange is increased upon the temperature in said radiator exceeding second a predetermined level;

an overflow port formed in said coolant jacket at a predetermined height above said structure, said overflow port fluidly communicating with the collection vessel of said radiator so that excess coolant pumped into said coolant jacket overflows through said overflow port to the lower tank; and a reservoir in which coolant is stored, said reservoir fluidly communicating with the collection vessel of said radiator.

2. A cooling system as claimed in claim 1, wherein said pump is arranged to pump coolant at a predetermined rate, said predetermined rate being selected to be higher than the maximum rate at which coolant is transferred to said radiator due to the boiling of the coolant in said coolant jacket.

3. A cooling system as claimed in claim 1, wherein said radiator is selected to have a heat exchange capacity greater than the maximum rate at which said engine is capable of producing heat.

4. A cooling system as claimed in claim 1, wherein said first and second predetermined temperature levels are set to correspond to the minimum temperature at which the coolant in the coolant jacket is apt to boil.

5. A method of cooling an internal combustion engine which has a structure subject to high heat flux, comprising:

introducing liquid coolant into a coolant jacket disposed about said structure;

permitting said coolant to boil and produce coolant vapor;

condensing the vapor produced in said coolant jacket in a radiator;

sensing the temperature of the coolant in said coolant jacket;

pumping coolant from said radiator to said coolant jacket in response to the temperature of the coolant in said coolant jacket being sensed as being above a first predetermined level;

permitting coolant in the coolant jacket above a predetermined height above said structure to overflow via an overflow port to said radiator;

sensing the temperature of the liquid coolant in said radiator;

varying the rate of heat exchange between said radiator and a cooling medium surrounding the same in a manner to increase the amount of heat removed from said radiator in response to the temperature of the liquid coolant in said radiator being above a second predetermined level.

6. A method as set forth in claim 5, wherein said step of pumping includes pumping coolant at a rate in excess of the maximum rate at which coolant is transferred from said coolant jacket to said radiator.

7. A method as claimed in claim 5, further comprising the steps of:

storing liquid coolant in a reservoir;

adjusting the amount of coolant in said radiator in response to the pressure differential which exists between the interior of said reservoir and the interior of said radiator.

* * * * *